US010683710B2

(12) United States Patent
Christopher et al.

(10) Patent No.: US 10,683,710 B2
(45) Date of Patent: Jun. 16, 2020

(54) DEVICE FOR ISOLATING A TOOL FROM AXIAL VIBRATION WHILE MAINTAINING CONDUCTOR CONNECTIVITY

(71) Applicant: Cathedral Energy Services Ltd., Calgary (CA)

(72) Inventors: Keith J. Christopher, Calgary (CA); Bogdan A. Picioreanu, Calgary (CA); Kyle Seitz, Calgary (CA)

(73) Assignee: CATHEDRAL ENERGY SERVICES LTD., Calgary, Alberta (CA)

( * ) Notice: Subject to any disclaimer, the term of this patent is extended or adjusted under 35 U.S.C. 154(b) by 53 days.

(21) Appl. No.: 15/607,873

(22) Filed: May 30, 2017

(65) Prior Publication Data

US 2018/0100357 A1 Apr. 12, 2018

Related U.S. Application Data

(60) Provisional application No. 62/405,388, filed on Oct. 7, 2016.

(51) Int. Cl.

| | |
|---|---|
| ***E21B 17/07*** | (2006.01) |
| ***E21B 17/02*** | (2006.01) |
| ***E21B 47/01*** | (2012.01) |

(52) U.S. Cl.

CPC ..... *E21B 17/07* (2013.01); *E21B 17/028* (2013.01); *E21B 47/011* (2013.01)

(58) Field of Classification Search

CPC ..... E21B 17/07; E21B 17/02; E21B 47/011; E21B 17/028; E21B 17/023

See application file for complete search history.

(56) References Cited

U.S. PATENT DOCUMENTS

| | | | | |
|---|---|---|---|---|
| 2,706,616 | A * | 4/1955 | Osmun | E21B 17/003 174/68.1 |
| 3,406,537 | A | 10/1968 | Falkner, Jr. | |
| 3,884,051 | A * | 5/1975 | Bottoms | E21B 17/07 175/321 |
| 4,186,569 | A | 2/1980 | Aumann | |
| 5,083,623 | A | 1/1992 | Barrington | |
| 8,640,795 | B2 | 2/2014 | Jekielek | |
| 8,739,862 | B2 | 6/2014 | Niina et al. | |
| 2009/0023502 | A1 | 1/2009 | Koger | |
| 2013/0206395 | A1 | 8/2013 | Cramer | |

(Continued)

FOREIGN PATENT DOCUMENTS

| | | |
|---|---|---|
| WO | 2015168226 A1 | 11/2015 |
| WO | 2016160017 A1 | 10/2016 |

OTHER PUBLICATIONS

Lord SoftShoeTM Info. Sheet.

Lord Axial Isolator MWD Shock Absorber for Probe-Style MWD Tools—Info. Sheet.

*Primary Examiner* — David J Bagnell

*Assistant Examiner* — Manuel C Portocarrero

(74) *Attorney, Agent, or Firm* — Field LLP

(57) ABSTRACT

A device is provided for isolating, from shock and vibration, any down-hole tool housed within a drill string, while maintaining rotational alignment and providing a continuous electrical connection between the ends of the tool along a plurality of conductor paths. The device increases down-hole tool life while reducing damage when operating in demanding environments.

20 Claims, 5 Drawing Sheets

(56) References Cited

U.S. PATENT DOCUMENTS

| | | | | |
|---|---|---|---|---|
| 2014/0196912 | A1* | 7/2014 | Turley | E21B 43/10 166/382 |
| 2014/0246210 | A1* | 9/2014 | Andersen | E21B 23/01 166/377 |
| 2015/0376959 | A1 | 12/2015 | Dinica et al. | |
| 2018/0045042 | A1* | 2/2018 | Lee | E21B 47/18 |

* cited by examiner

DEVICE FOR ISOLATING A TOOL FROM AXIAL VIBRATION WHILE MAINTAINING CONDUCTOR CONNECTIVITY

BACKGROUND OF THE INVENTION

During the process of directional drilling, real time bore hole positioning data as well as formation evaluation data is needed in order to effectively steer the well bore to the correct trajectory. These tools are interchangeably referred to as Measurement While Drilling (MWD) or Logging While Drilling (LWD) tools.

A typical MWD tool (also named string) is located in a nonmagnetic drill collar as part of the bottom hole assembly (BHA) throughout the drilling process. The MWD tool can be mechanically fixed to the collar (bolted in a special sub) or can be resting on a mechanical support and kept down gravitationally and with the aid of flow. To obtain accurate readings the tool must be as close to the drill bit as possible, maintain a particular rotational alignment with the high side of a motor's curvature and be separated by a minimum distance from any magnetic material in the drill string. Additionally, the tool must be mounted in such a way as to permit transmission of the signal by EM, Mud Pulse, or alternate telemetry system. Typically this mounting is completed as part of the telemetry system on a terminal end of the string.

As a result of the proximity of the MWD tool to the mud motor and the bit, it is exposed to an environment that has the highest vibration and shock loads in the drill string. Where MWD tools were historically able to withstand these loads, improved technology such as, increasingly aggressive drill bits, stronger mud motors, and devices such as agitators (specifically designed to incite a vibration in the drill string) are being used to increase the rates of penetration (ROP) and extend the depth and reach of directional wells resulting in a much more aggressive environment. As a result, the typical drilling environment is now so violent that MWD tools are no longer able to survive for extended or even moderate periods of time resulting in failures of the tools that can cause significant time and monetary losses to the drilling operator as well as the MWD supplier that must replace or repair the damaged equipment. The most pressing and damaging of these vibrational loads continues to be those applied along the long axis of the drill string (referred as axial vibration or vibration along the Z axis).

While various technologies have been developed in the past to mitigate these issues, each one of them is associated with specific shortcomings that have necessitated further development. For instance, solutions have been developed that are integrated directly into the drill string, these are referred to as "Shock Subs", "Shocks" or "Thrusters". Regardless of the specific design or technology used, all drill string based solutions necessarily increase the distance from the MWD sensor to the drill bit and can reduce the effectiveness of the agitator and can negatively affect drilling dynamics and cause a reduction in ROP.

Other systems have been developed integral to MWD strings such as rubber encased connections between electronics design to absorb shock; however these are ineffective at damping large displacements and low excitation frequencies, and only protect certain elements of the string.

In another attempt to solve this issue newly designed systems have tried to protect the MWD string as a whole, however, currently they are limited in that their design necessitates a location in the tool where no electrical wiring is needed, limiting its compatibility with certain MWD string geometries. Alternate designs are also known to use "sliding spline" or "sliding pin" systems as a means for transmitting torque while allowing axial motion. These sliding pin systems comprise either a pin axially moveable in a slot, or a cooperative arrangement of axial splines or ribs between components. They are particularly prone to a high degree of wear due to the sliding contact which results in a number of problems such as allowing some torsional or twisting movement or backlash between housings, which can actually increase torsional vibration in the tool; creating wear product that contaminates the tool environment and can cause further damage to other components and excessive frictional heat generation, which can be damaging to other components nearby. These tools are also longer and less robust due to the use of coil or disc springs, and are designed for use with specific narrow MWD string configurations and weights, limiting their use in the general case.

Details of the tools described above can be found in the prior art:

- US 20150376959 A1—Axial Lateral and Torsional Force Dampener
- U.S. Pat. No. 8,640,795 B2—Shock Reduction Tool For a Downhole Electronics Package
- US 2009/0023502—Downhole Shock Absorber for Torsional and Axial Loads
- U.S. Pat. No. 3,406,537—Shock Absorbing Sub Assembly
- U.S. Pat. No. 5,083,623—Hydraulic Shock Absorber
- WO 2015168226 A1—Snubber for Downhole Tool
- U.S. Pat. No. 4,186,569 A—Dual Spring Drill String Shock Absorber
- US 20130206395 A1—Method and Apparatus for Reducing Shock and Vibration in Down Hole Tools In view of the above limitations, there is need for a tool that can isolate the MWD String from the axial vibration while allowing a plurality of electrical paths through the tool, maintaining rotational alignment without excessive sliding friction, allowing for placement in any location of any tool string.

SUMMARY OF THE INVENTION

The invention herein describes a downhole tool on a tool string for isolating parts of the tool string from axial shocks and vibrations present in the drill string. Further, the tool can be customized at both ends, by altering connection geometry or by means of an adapter, for integration into any location of any downhole tool string and has the capability of maintaining electrical connectivity through the tool string for a plurality of separate conductor paths.

Considered broadly, the tool is comprised of a shaft assembly telescopically engaged within a housing assembly. A plurality of opposed spring elements are preferably housed between the shaft assembly and housing assembly such that upward and downward movement of the shaft assembly relative to the housing assembly is permitted but generates a restorative force in the spring elements. A pair of flanges is provided on the shaft assembly, which operatively engages with a mating pair of flanges on the housing assembly in order to provide limits of axial travel. A plurality of axial rolling ball bearings are housed between a plurality of inner raceways on one section of the shaft assembly and a plurality of outer raceways on the housing assembly, said ball bearing and raceway arrangement thus forming a linear bearing device that allows axial movement while prohibiting rotational motion of the shaft assembly in relation to the housing assembly. The interior of the tool contains a sealed chamber of lubricating hydraulic fluid and a flexible membrane is provided as a means of equalizing the pressure between the exterior and interior of the tool as well as compensating for changes in volume of the hydraulic fluid. A plurality of conductors is provided via a cable containing, in one embodiment of the design, a coiled section of retractile cable capable of extension and contraction, which is connected to a pressure feedthrough bulkhead at each terminating end, one being mounted within the shaft assembly and the other being mounted within the housing assembly. In a second embodiment of the invention, the retractile cable section is replaced with a linear sliding connector capable of relative axial movement between ends while maintaining a plurality of conductive paths. In either embodiment of the invention, an elastomeric membrane capable of extension and contraction is operatively connected to the housing assembly on one end and the shaft assembly on the other end in such a way as to create a sealed pressure chamber in the interstitial space around and within the shaft assembly and within the housing assembly. The pressure chamber is filled with a hydraulic fluid that lubricates the internal components and provides pressure compensation against collapse of the telescopic section due to the exterior pressure. The bottom of the shaft assembly is furnished with a plurality of bushings for stabilization within the housing assembly, and an electro-mechanical mount for attachment to the remainder of the tool string to be protected, that can be customized by means of an adapter or alteration of the end geometry. The upper end of the housing assembly is likewise furnished with an electromechanical mount for attachment to the tool string to be protected that can also be customized by means of an adapter.

BRIEF DESCRIPTION OF THE DRAWINGS

The tool itself, having a long slender aspect ratio, has been broken into a series of FIGS. 1-5 where the figures show various "segments" of the tool performing a certain function or group of functions. The figures themselves may be assembled in a top to bottom fashion to show the tool in its entirety. There exists some overlap on the segments of the tool shown from one figure to the next for clarity. A description of each figure, making up a portion of the specification is given here.

DETAILED DESCRIPTION OF THE INVENTION

The embodiment of the invention described here and referenced in the figures does not show or make reference to the necessary components required to adapt or customize the device for electromechanical coupling with a particular tool string. Geometry is provided on the tool and it is understood that the design of an adapter or attachment to the geometry provided is a basic and obvious practice for one skilled in the art.

Figure 6:
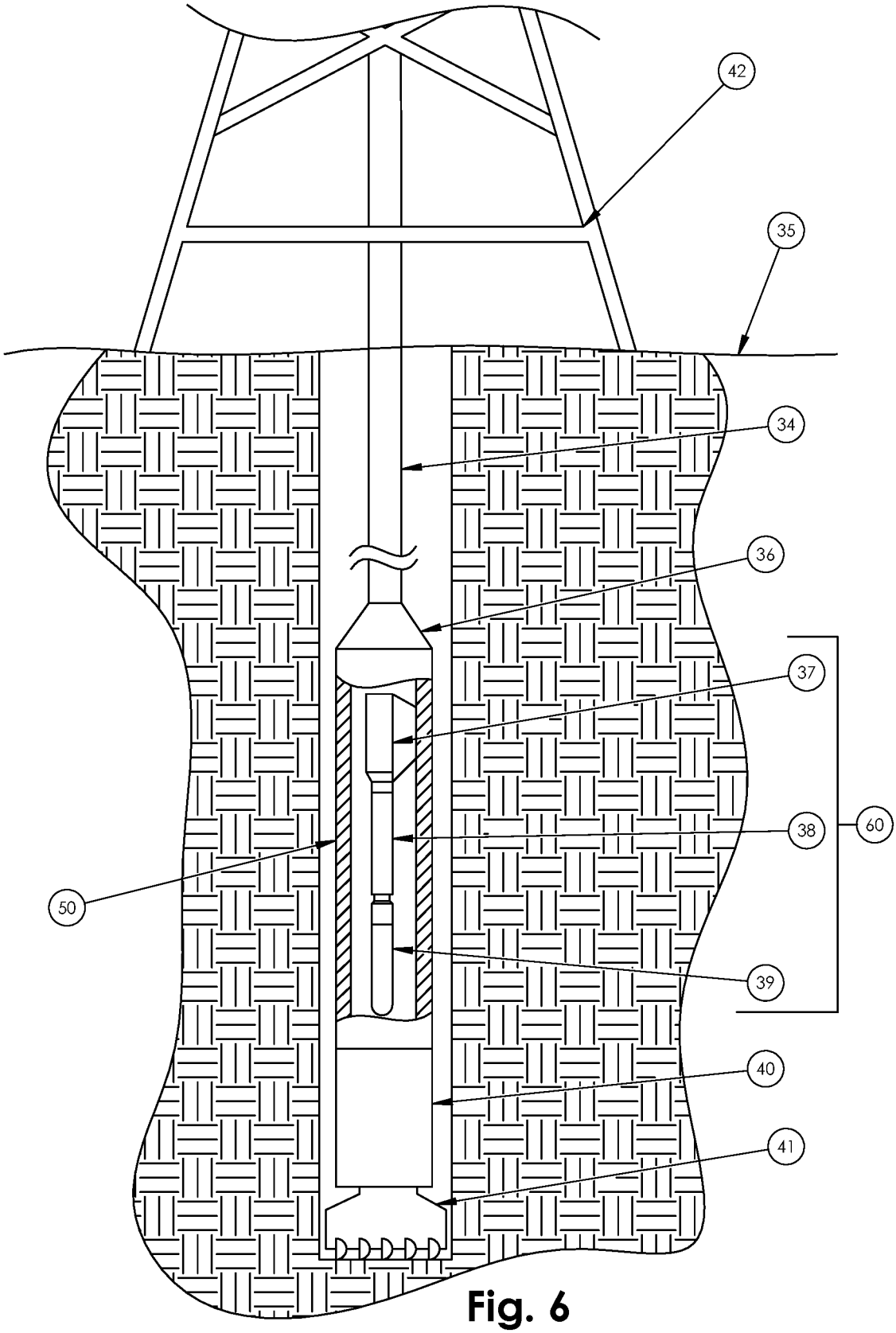
FIG. 6—Shows one possible mounting configuration of the invention when use as a component in a downhole tool string.
Figure 7:
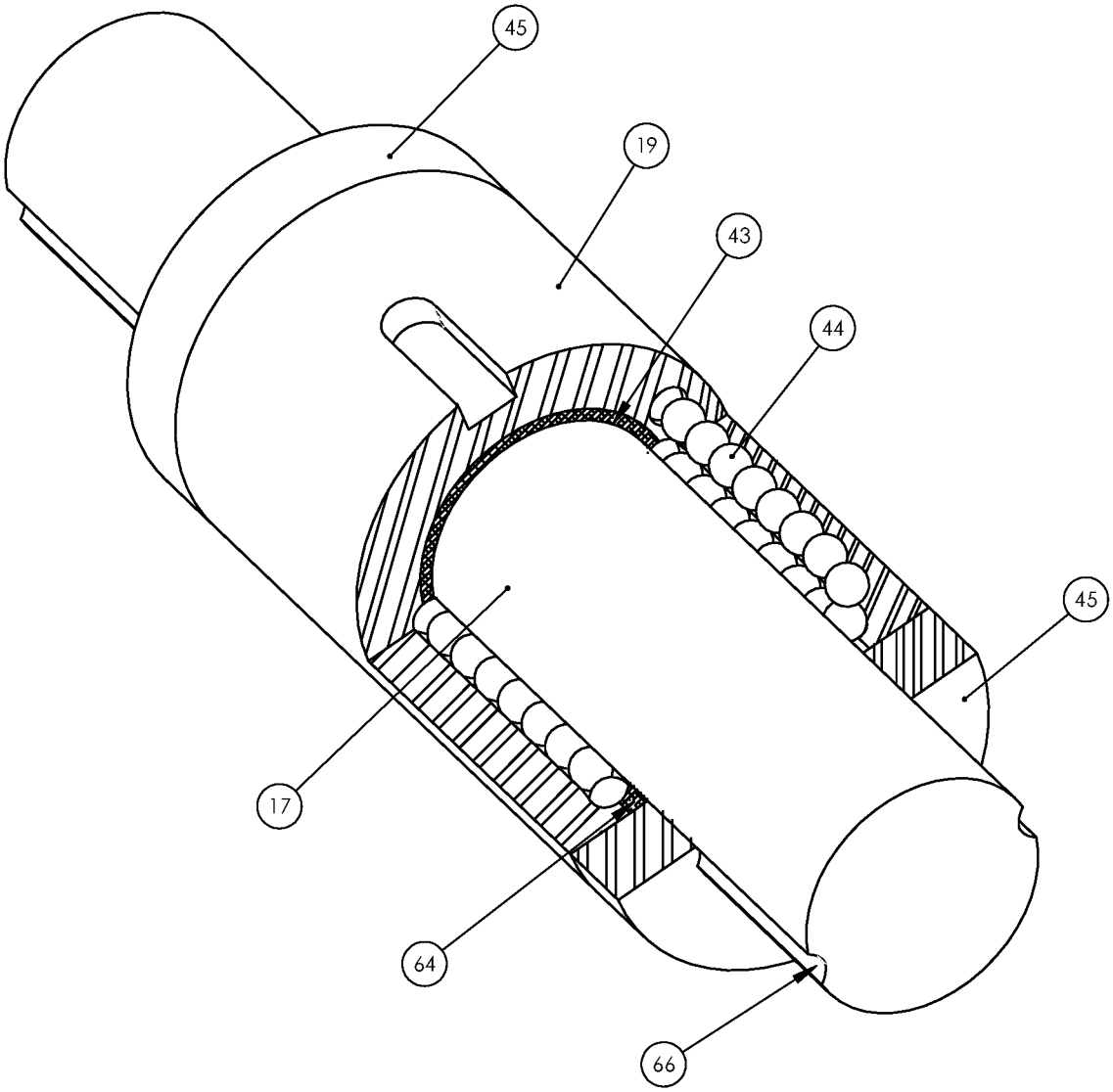
FIG. 7—Shows a detailed, isometric, partial cross sectional view of one embodiment of the bearing nut of the present invention.

Composition:

FIG. 6 shows the invention mounted in the typical method. It should be understood that this figure shows a greatly simplified representation of a drilling system for the purposes of illustrating the general intended use of the tool. It should be recognized that the use of the invention should not be interpreted as limited solely to that shown in the drawing and that the actual detailed composition of the drill string and the mounting location and details of the invention can be adjusted and modified for optimum performance without departing from the intended use of the invention.

The FIG. 6 shows a drilling rig (42) on the surface (35) that is connected to a length of drill pipe (34). The drill pipe is connected to a bottom hole assembly (BHA) (50) that comprises, in part, one or more drilling collars (36), of which one is illustrated in FIG. 6, a mud motor (40) and drill bit (41). The BHA (50) may contain other elements but they are not shown here for the sake of clarity. Within one of the drill collars (36) is shown a downhole tool string (60), one mounted portion (37) of which is operatively connected within the drilling collar (36), and more commonly to an interior sidewall of the drilling collar (36). The mounted portion (37) may be mounted by any known means in the art including by use of a muleshoe on a step on an inside wall of the collar (36), or as illustrated in FIG. 6, by means of a fin bolted to an interior sidewall of the collar (36) although any number of means may be applied without departing from the scope of the invention.

The tool (38) of the present invention connects the mounted portion (37) of the tool string (60) to the portion (39) of the tool string (60) needing to be isolated.

Figure 1:
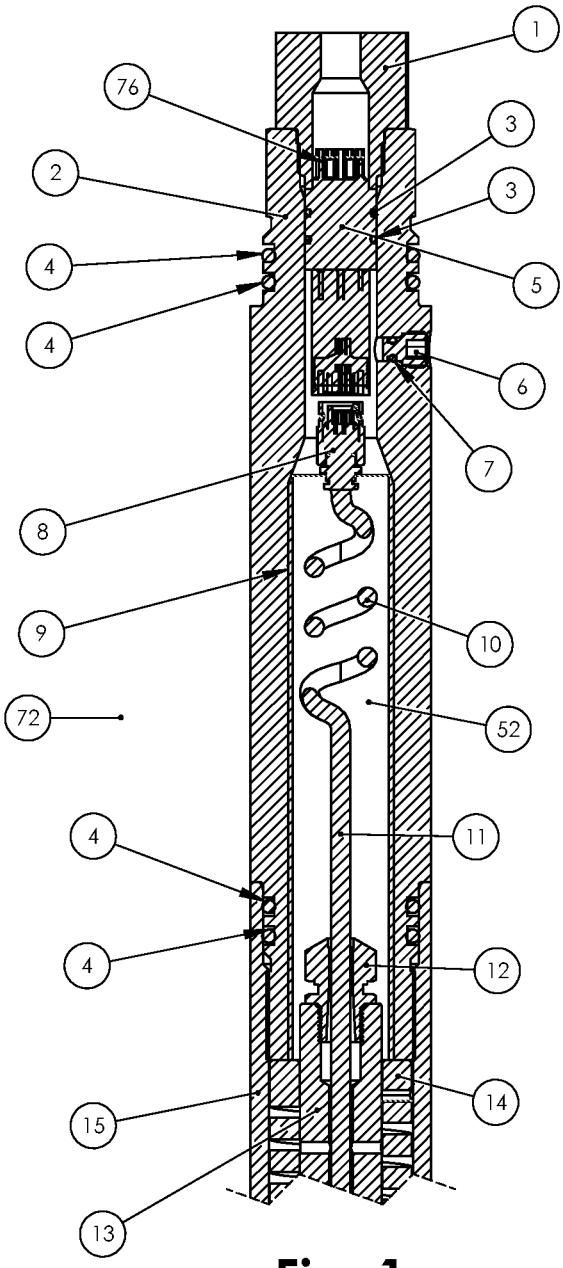
FIG. 1—Shows a cross sectional view of the "electronics segment" of the tool in accordance with one embodiment of the invention.

Referring to FIG. 1, an electrical segment of the tool is shown according to a first embodiment of the tool and comprised of the electrical housing assembly (2) defining an axial hydraulic cavity (52) that can be filled with a hydraulic fluid (not shown) for use in lubrication, pressure compensation and viscous damping. The electrical housing (2) further comprises a means for sealed mechanical attachment to the tool string (60), shown in this embodiment as using a threaded joint and O-ring (4) combination. Mounted within said electrical housing (2) is an electrical pressure feedthrough (5), containing a plurality of sealed conductors (not shown) and a means of sealing the electrical pressure feedthrough (5) to an inner surface of the electrical housing assembly (2), for example as shown FIG. 1, as O-rings (3) on the outer diameter of the electrical housing assembly (2).

This electrical pressure feedthrough (5) forms a separation between the interior of any tools on the tool string (6) uphole of the present tool (38), and the hydraulic cavity (52) of the tool (38) below. An uphole end of the feedthrough (5) provides terminals (76) for attachment of a plurality of conductors for adaptation to any desired tool. Said feedthrough (5) is held in place by locking nut (1) as well as by the internal positive pressure of the hydraulic fluid within the hydraulic cavity (52) of said electrical housing (2). Also provided in said electrical housing (2) is a threaded pressure plug (6) sealed with an exterior O-ring (7) provided as a means of filling and emptying the hydraulic cavity (52) of the tool (38) and providing a sealed barrier between the hydraulic chamber of the tool and the exterior environment.

An electrical connector (8) is connected to said feedthrough (5) and operatively attached to a retractile cable section (10). Said retractile cable section (10) sits in the hydraulic fluid cavity (52) of the tool (38), which is at least partially internally lined with a protective sleeve (9), mounted in an inner bore of said electrical housing (2). The retractile cable section (10) is connected to straight cable section (11). The straight cable section (11) is clamped by cable clamp (12) which is operatively connected to piloting shaft (13). The piloting shaft (13) makes up a terminal end of a shaft assembly (70) which is defined in more detail below. The retractile cable (10) serves as a means to accommodate a repeated change in the distance between cable clamp (12) and feedthrough (5) that is caused by vibration, without disruption of the plurality of conductor paths. Conductor paths can include any conductor paths contained in the cables (10) and (11) and running through the tool. The conductor paths can carry any type of signal, or power or other information from the downhole tool (39) to be isolated up through the tool string (60). Said electrical housing (2) is operatively connected to a spring housing (15) and sealed by means of O-rings (54).

Figure 2:
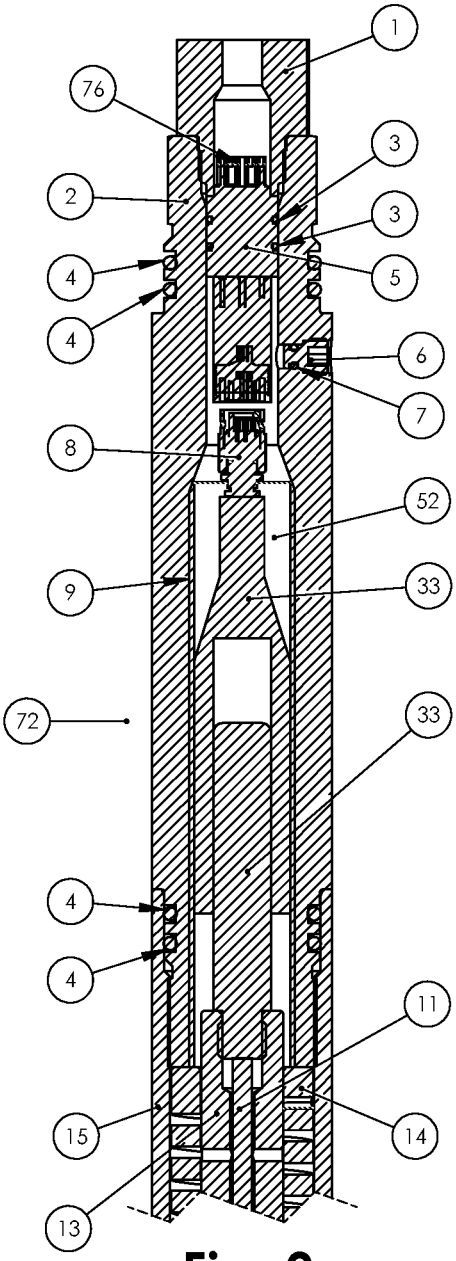
FIG. 2—Shows a cross sectional view of the "electronics segment" of the tool in accordance with a second embodiment of the invention.

Considering next FIG. 2, the electrical segment of the tool is shown according to a second embodiment of the invention. It is comprised of the same components as the first embodiment of the invention shown in FIG. 1, however in this embodiment, the retractile cable section (10) and cable clamp (12) is replaced with a linear sliding connector (33) which is operatively connected at an uphole end to the connector (8) and at a downhole end to the piloting shaft (13) and the straight cable section (11). The linear connector 33 is a connector containing a plurality of conductors which allows for continuous electrical connection while allowing axial movement due to vibration thus allowing for a change in distance between the piloting shaft (13) and the feedthrough (5) while maintaining connection along the plurality of conductors.

Figure 3:
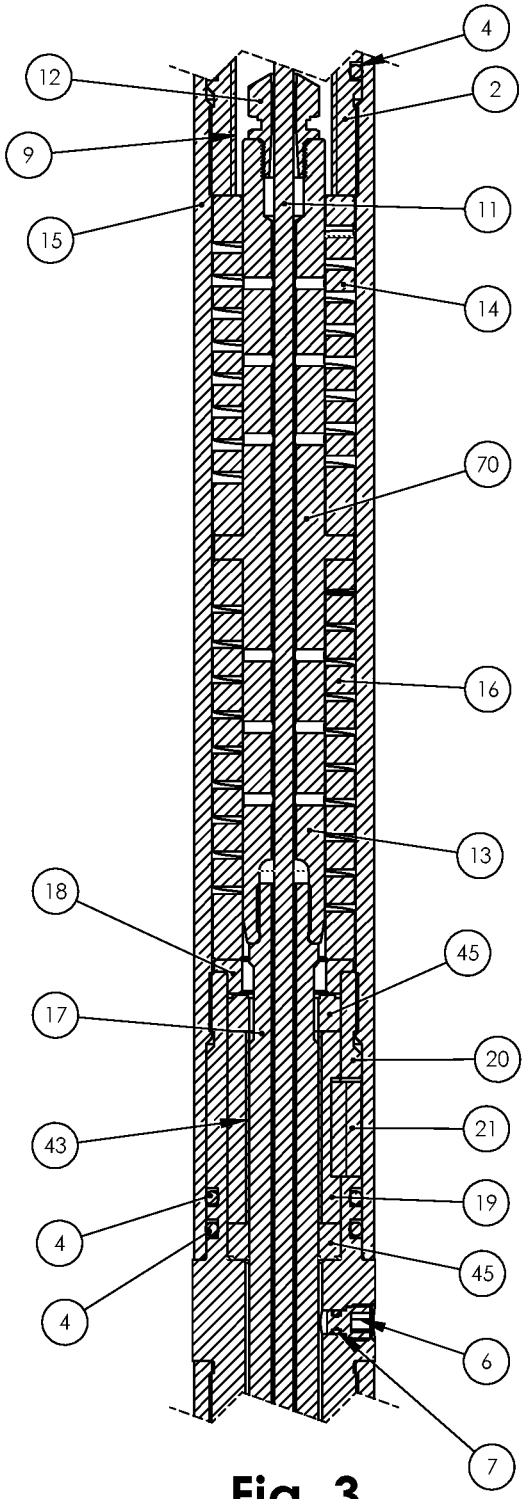
FIG. 3—Shows a cross sectional view of the "spring segment" of the tool in accordance with one embodiment of the invention.
Figure 4:
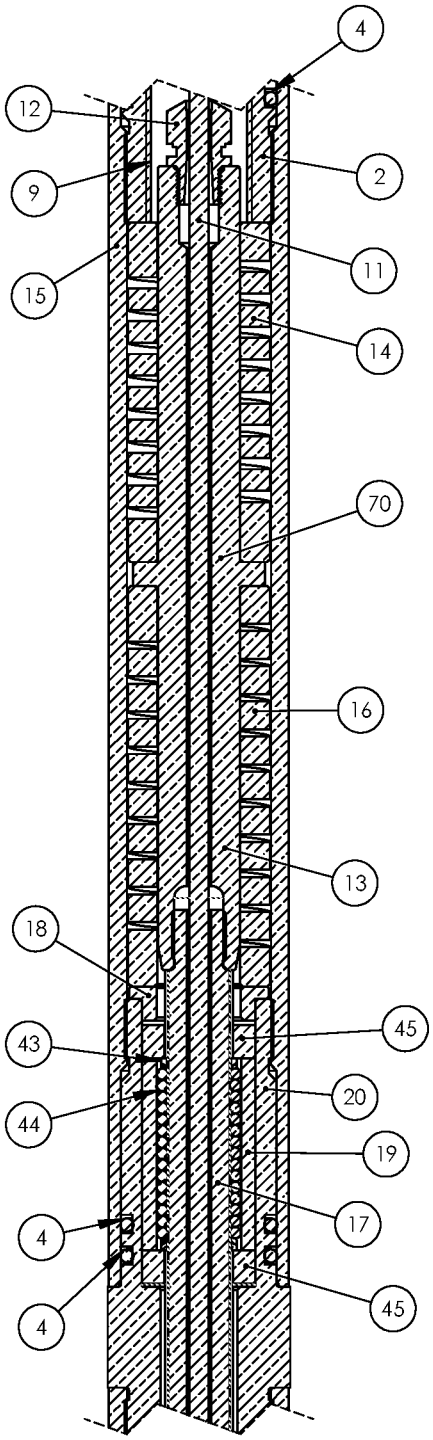
FIG. 4—Shows the cross sectional view of the "spring segment" of the tool rotated 90 degrees in order to view the linear bearing details.

Considering next FIG. 3 and FIG. 4, a spring segment of the tool is shown, which can be part of either embodiment of the electrical segment of FIGS. 1 and 2, but is illustrated as a continuation of FIG. 1. The spring segment is comprised of a spring housing (15) operatively connected on a top end to said electrical housing (2) and operatively connected on a bottom end to torsional housing (20). An upper spring element (14), housed within said spring housing (15) and piloting on said piloting shaft (13) is clamped between said electrical housing (2) and a flange of said piloting shaft (13) providing a means for the piloting shaft (13) to exert a force through the spring (14) to vary the length between the electrical housing (2) and the piloting shaft (13). This creates a force path through the springs, said force path being variable as the shaft assembly (70) moves relative to the housing assembly (72).

A lower spring element (16) housed within said spring housing (15) and piloting on said piloting shaft (13) is clamped between the flange of said piloting shaft (13) and spacer block (18) where said spacer block (18) is itself operatively installed against the end face of torsional housing (19) thus providing a variable length force path between the piloting shaft (13) and to exert a force through the lower spring (16) to the torsional housing (20).

In the preferred embodiment of the invention, the stress profile of each of the spring elements (14, 16) at their limit of travel is within the infinite fatigue limit of the material from which the spring is made.

In the preferred embodiment of the invention the spring elements (14, 16) are manufactured with different dimensions and spring rates and in the presence of no compressive or tensile forces, will return the piloting shaft (13) to a biased position with respect to the limits of travel.

In the preferred embodiment of the invention, the bias introduced by the spring elements (14, 16) will be essentially equal and opposite to the bias introduced by the expected "dead load" of the tool to be isolated.

The upper and lower springs (14) and (16) work together to operatively maintain the position of the piloting shaft (13) when the tool is not subjected to vibrations. Further, the piloting shaft (13) contains an axial passage for the cable (11) as well as a plurality of cross axis holes that provide for movement of hydraulic fluid within the tool (38). Piloting shaft (13) is operatively connected to bearing shaft (17) that houses a retainer (43). A bearing nut (19) and a plurality of ball bearings (44) are moveably held between a plurality of axial raceways (64) formed on the bearing nut (19) and mating raceways (66) formed on the bearing shaft (17). The spherical ball bearings (44) transmit torque from the bearing shaft (17) to the bearing nut (19) while being able to roll axially along the raceway axis to provide axial motion with little or no sliding friction. In the preferred embodiment the bearing balls (44) are preloaded within the bearing nut raceways (64) to provide torsional rigidity with no backlash or lateral movement. The ball bearing (44) and raceway (64, 66) arrangement allows axial translation of the bearing shaft (17) in relation to the bearing nut (19) while preventing any relative rotational movement of the bearing nut (19) around the bearing shaft (17). The ball bearings and raceways of the present invention preferably operate within the general manner of linear spline bearing assemblies.

The bearing nut (19) is housed within a bore of the torsional housing (20) and axially restrained by means of a flange on the torsional housing (20) and the spacer block (18). A key (21) or set screw is used to prevent relative rotation between the torsional housing (20) and the bearing nut (19). However, it would be understood by a person of skill in the art that the bearing nut (19) could also be formed as an integral part of the torsional housing (20) and also that the one or more raceways (64) could be formed directly into the torsional housing (20) without the need for a bearing nut (19) at all.

The torsional housing (20) further provides a second threaded pressure plug (6) and sealing O-ring (7) as a means for oil addition and removal from the lower portion of the tool and a barrier between the hydraulic cavity (52) of the tool (38) and the external environment.

Figure 5:
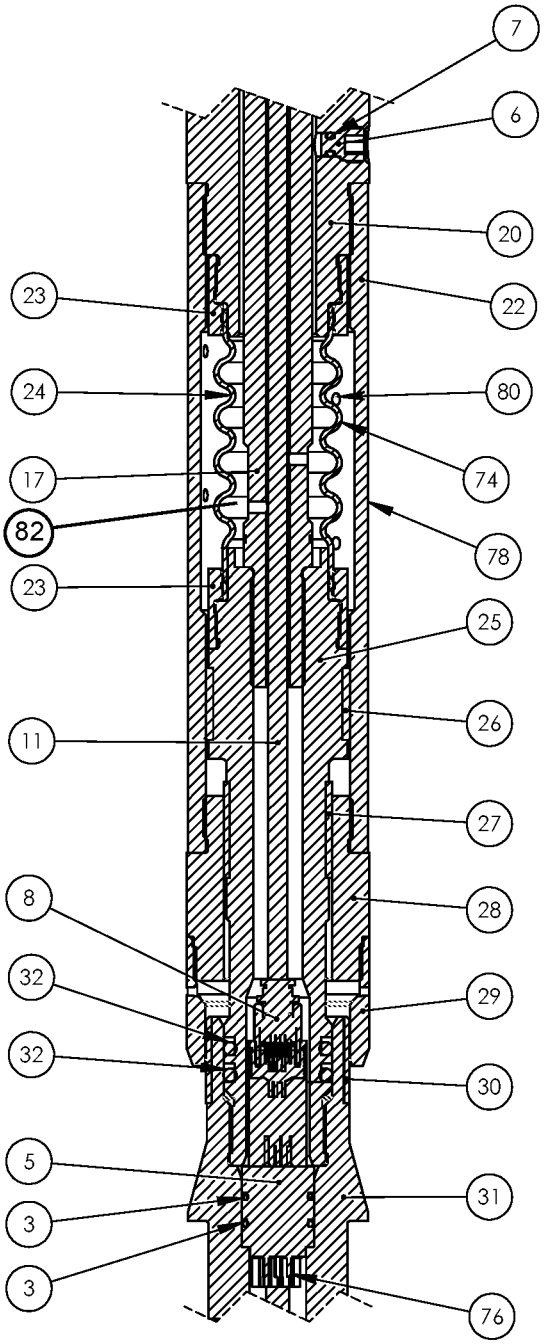
FIG. 5—Shows a cross sectional view of the "compensation segment" of the tool in accordance with one embodiment of the invention.

Considering next FIG. 5, a compensation segment or compensation system is shown as being connected to a downhole end of the spring segment. The torsional housing (20) of the spring segment of the tool (38) is preferably operatively connected at a downhole end to a compensation housing (22). The compensation housing (22) of the compensation system comprises a shroud (78) having a plurality of holes (80) formed there in. The shroud holes (80) allow communication of any external fluid with an interior of the compensation housing (22) while the shroud (78) provides the interior components with protection from the bulk external fluid flow into the compensation housing. Also mounted to the lower end of the torsional housing (20) is a compensation membrane (24). Membrane (24) is flexible and is operatively connected to torsional housing (20) at a first end and to a membrane locking shaft (25) a second end, creating a fluid tight flexible joint between the housing assembly (72) and the shaft assembly (11). A chamber (82) is defined between the compensation membrane (24) and the bearing shaft (17).

In a preferred embodiment of the invention, attachment and sealing of the compensation membrane (24) is achieved by means of membrane clamp (23) and mating clamp geometry on torsional housing (20) and locking shaft (25). The compensation membrane (24) is clamped, in such a manner as to retain and form a fluid seal, separating fluids between the compensation membrane (24) and the bearing shaft (17) from fluids between the compensation membrane (24) and the compensation housing (22).

In a further preferred embodiment of the invention, the membrane (24) is made from an elastomeric material capable of withstanding the temperatures, pressures, and chemicals encountered during the drilling process and are provided with a plurality of convolutions (74) that allow its extension and contraction, within specified limits of travel.

In the preferred embodiment of the invention, the membrane (24) is designed to permit a specified volume of expansion and contraction in order to accommodate changes in the hydraulic fluid volume while maintaining the hydraulic fluid pressure at essentially the same pressure as the external fluid pressure.

While the compensation system is shown for use in the present anti-vibration tool, the inventors have found that the present compensation system can be used in any linear actuator or linear actuation device to provide both pressure compensation between an external and an internal fluid and to provide sealing of an internal segment of a linear actuator from an external segment. The unique combination achieving both sealing and pressure or volume compensation by one system reduces the number of elements needed in typical linear actuation devices. In such cases, the torsional housing would be replaced by the housing of any linear actuator elements that make up the actuator housing uphole of the compensation system.

The bearing shaft (17) passes through the interior of the compensation membrane (24) and is operatively attached to the membrane locking shaft (25). A plurality of openings are provided through the wall of the torsional bearing shaft (17) for allowing hydraulic fluid transfer between the various segments of the tool (38). The cable (11) runs through the bores of both the torsional shaft (17) and the membrane locking shaft (25) and terminates in a connector (8).

The compensation housing (22) is operatively connected on a downhole end to a shaft limiting nut (28). The nut (28) provides a solid flange on both the top and the bottom for limiting the travel of the shaft assembly (70) (to be described in further detail below) in relation to the housing assembly (72). The shaft limiting nut (28) is operatively connected on its downhole end to a protection sleeve (29), which is also fitted with a plurality of holes to facilitate transfer of the drilling fluid.

The membrane locking shaft (25) is preferably fitted with a plurality of bushings (26) and (27), which engage with compensation housing (22) and shaft limiting nut (28) respectively, and provide lateral stability of the shaft assembly within the housing assembly. The membrane locking shaft (25) is operatively connected on the lower end to the lower shaft coupler (31) and sealed with O-rings (32). The exterior of the lower shaft coupler (31) is fitted with bushing (30) which mates with the bore of the protection sleeve (29) to provide additional lateral stability of the shaft assembly. An electrical feedthrough (5) carrying a plurality of sealed conductors and operatively sealed on the outer diameter by O-rings (3) is connected to connector (8) and mounted within the lower shaft coupler (31) and restrained in place by the flange of the lower shaft coupler (31) and the face of the membrane locking shaft (25) and marks the end of the conductor path through the tool (38) and the barrier between the hydraulic cavity (52) and the interior chamber of the downhole tool (39) to which the present tool (38) is attached.

The remaining geometry of lower shaft coupler (31) and the electrical connection to the bottom end of electrical feedthrough (5) is not shown with these Figures but may be customized or configured to allow for compatible electromechanical attachment with any downhole tool (39) desired.

For the purposes of the present invention, the term housing assembly (72) is considered to include the electrical housing (2), the spring housing (15), the torsional housing (20), the compensation housing (22), the shaft limiting nut (28) and the protection sleeve (29). The elements of the housing assembly (72) remain fixed and do not move axially.

The term shaft assembly (70) is considered to include either of retractile cable (10) or the linear sliding connector (33) together with the piloting shaft (13), the bearing shaft (17), the lower shaft coupler (31) and the membrane locking shaft (25). The elements of the shaft assembly (70) move axially in response to vibrations in the drill string.

Preferably, all of the components of the present tool (38) are suitable for operation at temperatures up to 200 C. Further preferably, all of the components of the present downhole tools are made of non-magnetic materials.

Operation:

In the preferred embodiment the tool (38) of the present invention is mounted between the portion (39) of the tool string (60) to be isolated and the portion (37) of the tool string (60) which is affixed to the drill string. Although the present tool (38) can be configured for mounting in various orientations, the assumption made for the purposes of this description is that the housing assembly (72), made up of components electrical housing (2), the spring housing (15), the torsional housing (20), the compensation housing (22), shaft limiting nut (28), and protection sleeve (29), is connected to the portion (37) of the tool string (60) that is affixed to the drill string. The shaft assembly (70), made up of components lower shaft coupler (31), membrane locking shaft (25), bearing shaft (17), piloting shaft (13), is connected to the remainder of the tool string (39) which is to be isolated.

When placed into operation, the external drilling fluid surrounds the tool at high pressure and high flow and exerts a force on the compensation membrane (24) which, in turn, causes pressure of the hydraulic fluid within the hydraulic fluid cavity (52) to rise to the same pressure as the external drilling fluid. This eliminates any tendency of the tool (38) to compress due to exterior fluid pressure.

When in the idle position, the opposing spring elements (16) and (14) maintain a predetermined neutral position of the shaft assembly (70) with respect to the housing assembly (72), the spring elements (16), (14) being configurable and configured to provide a bias to compensate for the effect of the tool string (60) dead load.

When the drill string is subject to vibration, the housing assembly (72) is initially displaced some axial distance, for example axially downhole or downwardly, with respect to the shaft assembly (70). As the housing assembly (72) moves relative to the shaft assembly (70), the upper spring element (14) is compressed against the electrical housing (2) and the flange of the piloting shaft (13) while the lower spring element (16) is allowed to extend thus creating a downhole or downward force on the shaft assembly (72).

The decrease in distance between the electrical connections is accommodated by the retractile cable section (10) or the sliding connector (33) depending on the embodiment of the invention. The torsional shaft (17) is allowed to translate through the bearing nut (19) by rolling on the bearings (44) while being restricted in rotation by the raceways (64), (66), with minimal to no backlash, lateral movement or frictional wear. The compensation membrane (24) is compressed and the convolutions (74) grow in amplitude in order to accommodate relative motion between the shaft assembly (70) and the housing assembly (72), while maintaining integrity without the need for dynamic seals. The hydraulic fluid is permitted to re-distribute throughout the hydraulic cavity (52) of the tool (38) via the various openings and holes provided. The relative movement is allowed to continue until such time as the initial displacement reaches its maximum and begins to reverse or the shaft limiting nut (28) makes contact with the lower shaft coupler (31). At the point where the housing assembly (72) displacement reaches its maximum, the direction of displacement is then assumed to reverse and return to its original position. It is understood that the system generally functions in an equal but opposite analogous manner for uphole or upwards initial displacement of the housing assembly (72), with all relationships operating in reverse.

Although the components herein have been described within the context of the preferred embodiments of the invention, it is should not be interpreted as being limited solely to the exact description as it is understood that minor alterations, substitutions or modifications of components, can be made by those skilled in the art without departing from the intended scope of the invention.

The embodiments of the invention in which an exclusive property or privilege is claimed are defined as follows:

1. A downhole tool for use in a tool string isolating one or more portions of the tool string from axial displacement while maintaining electrical connectivity through said tool string and maintaining rotational alignment of elements within the tool, said tool comprising:

a. a housing assembly;

b. a shaft assembly telescopically engaged within the housing assembly;

c. one or more spring elements arranged axially on the shaft assembly, between the housing assembly and the shaft assembly for transmitting axial force between the housing assembly and the shaft assembly during axial movement of the shaft assembly relative to the housing assembly;

d. one or more rolling elements arranged between the housing assembly and the shaft assembly for preventing relative rotation between the housing assembly and the shaft assembly while allowing axial translation of the shaft assembly within the housing assembly;

e. a plurality of conductor paths running through the shaft assembly and terminating at each end in connectors affixed to each of said housing assembly and said shaft assembly, wherein said conductor paths are length adjustable to accommodate changes in the distance between the connectors while maintaining connectivity through the conductor paths; and f. a pressure compensation, volume compensation and lubrication system, comprising:

i. a sealed chamber of hydraulic fluid, said chamber defined between the shaft assembly and a compensation membrane, wherein a first end of said compensation membrane is operatively connected to the housing assembly and a second end of said compensation membrane is operatively connected to a membrane locking shaft to seal the sealed chamber around the shaft assembly in the absence of dynamic seals, ii. wherein said compensation membrane is extendable and contractible to both equalize pressure between an exterior of the tool and an interior of the tool; and compensate for changes in volume of hydraulic fluid in the sealed chamber as the shaft assembly translates with respect to the housing assembly.

2. The downhole tool of claim 1 wherein said one or more springs is comprised of an upper spring element and a lower spring element wherein each of the upper and lower spring elements are clamped at first end to opposing flanges on the housing assembly and clamped on a second end to a flange of the shaft assembly.

3. The downhole tool of claim 2, wherein said upper spring and lower spring elements are each manufactured with different dimensions and spring rates.

4. The downhole tool of claim 3 wherein a stress profile of each of the spring elements at their limit of travel is within an infinite fatigue limit of a material from which the springs are made.

5. The downhole tool of claim 3 wherein the springs are configured to provide a bias to return the tool to a neutral position when there is an absence of axial forces between the housing assembly and the shaft assembly.

6. The downhole tool of claim 1 wherein the one or more rolling elements comprise a linear rolling element bearing, the linear rolling element bearing comprising:

a. one or more first axial raceways on an inner surface of the housing assembly;

b. one or more second axial raceways formed on an outer surface of the shaft assembly to complement each first axial raceway; and c. a cage and ball arrangement axially rollable between the first and second axial raceways.

7. The downhole tool of claim 6, wherein said one or more first axial raceways are formed on a bearing nut housed between the housing assembly and the shaft assembly.

8. The downhole tool of claim 6 wherein the sealed chamber of hydraulic fluid is further sealed by means of an electrical pressure feedthrough mounted at each end of the conductive path.

9. The downhole tool of claim 6 wherein the compensation membrane is comprised of:

a. a cylindrical elastomeric membrane comprising a plurality of convolutions;

b. a first clamping mechanism for clamping a first end of said cylindrical membrane to the shaft assembly, thus creating a first static seal; and c. a second clamping mechanism for clamping a second end of the cylindrical membrane to the housing assembly, thus creating a second static seal;

wherein the cylindrical membrane is extendable and contractible to accommodate motion of the translating shaft assembly.

10. The downhole tool of claim 9, where the elastomeric membrane is further designed to allow for radial expansion and contraction in order to compensate for volume changes of the lubricating medium and maintain roughly equivalent pressure between the lubrication chamber and the exterior of the tool.

11. The downhole tool of claim 9 wherein the elastomeric membrane is covered by a housing shroud with a plurality of openings for allowing fluid communication between an exterior of the membrane and external drilling fluid.

12. The downhole tool of claim 1 wherein changes in the distance between the electrical conductor paths is achieved by means of a retractile coiled cable formed as part of the conductor paths.

13. The downhole tool of claim 1 wherein changes in the distance between the electrical conductors is achieved by means of a linear translating electrical connector formed as part of the conductor paths.

14. The downhole tool of claim 1 wherein the shaft assembly is furnished with passages to allow movement of hydraulic fluid within the tool.

15. The downhole tool of claim 1 wherein all components are suitable for operation at temperatures up to 200 C.

16. The downhole tools of claim 1 wherein all components are non-magnetic.

17. A sealing, volume compensation and pressure compensation system for use with a linear actuation device, said system comprising:

i. a sealed chamber of hydraulic fluid, said chamber defined between a shaft assembly and a compensation membrane, wherein a first end of said compensation membrane is operatively connected to a housing assembly and a second end of said compensation membrane is operatively connected to a membrane locking shaft to seal the sealed chamber around the shaft assembly in the absence of dynamic seals, ii. wherein said compensation membrane is extendable and contractible to both:

equalize pressure between an exterior of the linear actuation device and an interior of the linear actuation device; and compensate for changes in volume of hydraulic fluid in the sealed chamber as the shaft assembly translates with respect to the housing assembly.

18. The sealing, volume compensation and pressure compensation system of claim 17, wherein said compensation membrane comprises a. a cylindrical elastomeric membrane comprising a plurality of convolutions;

b. a first clamping mechanism for clamping a first end of said cylindrical membrane to a first movable segment, thus creating a first static seal; and c. a second clamping mechanism for clamping a second end of the cylindrical membrane to a second, fixed segment, thus creating a second static seal;

wherein the cylindrical membrane is extendable and contractible to accommodate the motion of the translating first segment relative to the fixed second segment.

19. The sealing, volume compensation and pressure compensation system of claim 18, wherein the elastomer membrane is further designed to allow for radial expansion and contraction in order to compensate for volume changes of the sealed chamber of hydraulic fluid and maintain roughly equivalent pressure between the sealed chamber of hydraulic fluid and an exterior of the linear actuation device.

20. The sealing, volume compensation and pressure compensation system of claim 19 wherein the elastomer membrane is covered by a housing shroud with a plurality of openings for allowing fluid communication between an exterior of the membrane and external fluid.

* * * * *